US006726600B2

(12) United States Patent
Miller

(10) Patent No.: US 6,726,600 B2
(45) Date of Patent: Apr. 27, 2004

(54) COMPACT, ELLIPTICAL EXERCISE DEVICE

(76) Inventor: Larry D. Miller, 4030 Oak Tree Cir., Rochester, MI (US) 48306

( * ) Notice: Subject to any disclaimer, the term of this patent is extended or adjusted under 35 U.S.C. 154(b) by 60 days.

(21) Appl. No.: 09/977,662

(22) Filed: Oct. 15, 2001

(65) Prior Publication Data

US 2003/0027690 A1 Feb. 6, 2003

Related U.S. Application Data

(60) Provisional application No. 60/309,842, filed on Aug. 3, 2001.

(51) Int. Cl.[7] ..... A63B 69/16; A63B 22/04

(52) U.S. Cl. ..... 482/51; 482/52; 482/70

(58) Field of Search ..... 482/57, 51, 52, 482/70, 53, 79, 80

(56) References Cited

U.S. PATENT DOCUMENTS

| | | | | |
|---|---|---|---|---|
| 5,045,488 A | | 9/1991 | Yeh | 437/43 |
| 5,352,169 A | * | 10/1994 | Eschnbach | 482/57 |
| 5,759,136 A | | 6/1998 | Chen | 482/57 |
| 5,762,588 A | | 6/1998 | Chen | 482/57 |
| 5,779,599 A | * | 7/1998 | Chen | 482/57 |
| 5,792,026 A | | 8/1998 | Maresh et al. | 482/51 |
| 5,893,820 A | | 4/1999 | Maresh et al. | 482/51 |
| 5,895,339 A | | 4/1999 | Maresh | 482/51 |
| 5,921,894 A | | 7/1999 | Eschenbach | 482/57 |
| 6,042,512 A | | 3/2000 | Eschenbach | 482/52 |
| 6,045,488 A | | 4/2000 | Eschenbach | 482/52 |
| 6,077,196 A | | 6/2000 | Eschenbach | 482/51 |
| 6,077,198 A | | 6/2000 | Eschenbach | 482/52 |
| 6,080,086 A | | 6/2000 | Maresh et al. | 482/57 |
| 6,090,014 A | | 7/2000 | Eschenbach | 482/52 |
| 6,217,485 B1 | | 4/2001 | Maresh | 482/52 |

* cited by examiner

*Primary Examiner*—Stephen R. Crow
(74) *Attorney, Agent, or Firm*—Gifford, Krass, Groh, Sprinkle, Anderson & Citkowski, P.C.

(57) ABSTRACT

A compact, elliptical exercise device includes a pair of primary foot links, and a pair of corresponding auxiliary foot links. A first end of each primary foot link is coupled to a pivot axis so as to move in an arcuate path. A second end of each primary foot link is connected to a guide assembly, which constrains it to travel in a reciprocal path of motion. A first end of each auxiliary foot link is coupled to the guide assembly at a connection point spaced from an engagement point at which its respective primary link is connected. Each auxiliary link is slidably supported by a respective one of its primary foot links so that a second end of each auxiliary foot link will travel in a reciprocal path along the primary foot link.

21 Claims, 5 Drawing Sheets

COMPACT, ELLIPTICAL EXERCISE DEVICE

RELATED APPLICATION

This patent application claims priority of provisional patent application Ser. No. 60/309,842 filed Aug. 3, 2001, and entitled "Compact Elliptical Exercise Device."

FIELD OF THE INVENTION

This invention relates generally to exercise equipment. More specifically, the invention relates to elliptical exercisers of the type wherein a user's foot travels in a generally elliptical path. Most specifically, the invention relates to an elliptical exercise device that is compact in size.

BACKGROUND OF THE INVENTION

Elliptical exercise devices provide a low impact aerobic form of exercise in which a user's feet move along a generally elliptical path of travel, which simulates a natural running and stepping motion. The action of such devices is generally superior to that achieved by stair steppers or ski machines; and as a consequence, elliptical exercise devices are in very wide use, and a number of embodiments of such devices are known in the art.

One problem that has been encountered with elliptical exercise devices of the prior art is that the mechanical linkages of such devices occupy a relatively long space. This limits the placement of such devices. Also, it has been found desirable to make elliptical exercise devices adjustable so as to accommodate longer or shorter stride lengths; and various approaches to such adjustability further lengthens the mechanical linkages of such devices. Finally, in some instances it is desirable to modify the shape of the elliptical path of foot travel achieved by devices of this type. A number of approaches to modifying the foot path have been implemented; however, such approaches generally involve complicated mechanical linkages, which further increase the size of the device. Clearly, there is a need for a compact elliptical exercise device that can be adjusted to accommodate various stride lengths and to provide various elliptical paths of foot travel.

The present invention is directed to an elliptical exercise device which is compact in size, but which can accommodate a long stride as well as a shorter stride. Furthermore, the device of the present invention allows a user to adjust the path of foot travel to achieve maximum benefit. These and other advantages of the present invention will be described herein below.

BRIEF DESCRIPTION OF THE INVENTION

There is disclosed herein a compact exercise device. The exercise device includes a frame configured to be supported on a floor. The frame has at least a first pivot axis defined thereupon. The device further includes a first and a second primary foot link. Each primary foot link has a first and a second end, and a coupling member, to the first pivot axis, couples a first end of each foot link, so that the first end of each primary foot link is constrained to travel in an arcuate path. The device further includes a guide assembly that is operative to engage the second end of each of the primary foot links at an engagement point defined thereupon. The guide assembly operates to direct the second ends of the primary foot links in a reciprocating path of travel as the first ends travel in the arcuate path. The exercise device further includes a first and a second auxiliary foot link. Each auxiliary link is configured to receive a user's foot, and each has a first end, which is coupled to the guide assembly at a connection point defined thereupon. The connection point is spaced from the engagement point. Each auxiliary link is slidably supported by a respective one of the primary foot links so that a second end of each auxiliary foot link will travel in a reciprocal path along a portion of the length of its respective primary foot link, between the first and second ends thereof, when the first end of the respective primary foot link travels in its arcuate path, and when the second end of the respective primary foot link travels in the reciprocal path.

In specific embodiments, the guide assembly includes a first and a second swing arm pivotally supported on the frame at a second pivot axis. In this embodiment, each swing arm is pivotally connected to the primary foot links at an engagement point, and to the auxiliary foot links at a connection point. In other embodiments, the guide assembly may include a track, which may be supported by the frame. The track directs the second ends of the primary foot links in a reciprocal path of travel. In this embodiment, there may further be included an auxiliary link which engages and directs the first ends of the auxiliary foot links.

In specific embodiments, the primary and/or auxiliary foot links may include curved or other non-planar segments which function to vary the path of travel of the various linkages, and hence to vary the foot path action achieved by the device.

The various connections and engagement points of the apparatus may be made adjustable so as to allow for variation in the stride length and foot path achieved by the device. The adjustability may be accomplished manually or automatically. In specific embodiments, the various connections may be automatically adjusted while the device is in use.

DESCRIPTION OF THE INVENTION

The exercise device of the present invention includes a frame member configured to be supported on a floor. The frame has at least a first pivot axis defined thereupon. The device further includes a first and a second primary foot link, and each foot link has a first end and a second end. The device includes first and second coupling members; each coupling member is disposed so as to couple the first end of a respective one of the primary foot links to the first pivot axis to that the first end can travel in an arcuate path. The device also includes a guide assembly which is operative to engage the second end of each of the primary foot links at an engagement point defined upon the guide assembly, and is further operative to direct the second end of each of the primary foot links in a reciprocating path of travel as the first ends travel in the arcuate path. The apparatus also includes a first and a second auxiliary foot link. Each auxiliary foot link has a first end that is coupled to the guide assembly at a connection point defined upon the guide assembly. The connection point is spaced from the engagement point. Each auxiliary link is slidably supported by a respective one of the primary foot links. In the operation of the device, the second end of each auxiliary foot link travels in a reciprocal path along a portion of the length of its respective primary foot link when the first end of the primary foot link travels in an arcuate path and the second end of the primary foot link travels in a reciprocal path.

Figure 1:
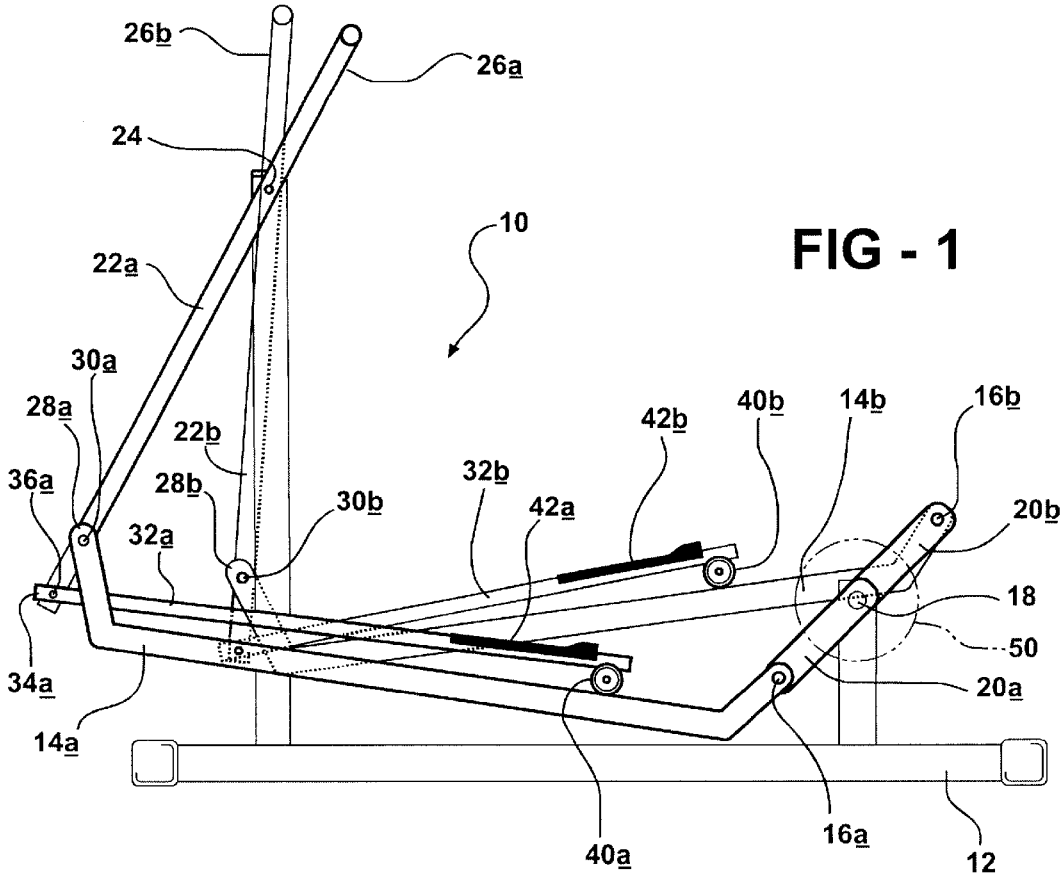
FIG. 1 is side elevation view of one embodiment of exercise device structured in accord with the principles of the present invention.

Referring now to FIG. 1, there is shown a first embodiment of elliptical exercise device structured in accord with the principles of the present invention. This device 10 includes a frame 12 which is configured to be supported on a floor. The frame is preferably fabricated from metal, and operates to support and retain the other elements of the device. As illustrated in FIG. 1, the exercise device 10 includes a pair of primary foot links 14*a,* 14*b.* These foot links 14 are generally similar, and each includes a first end 16*a,* 16*b,* which is mechanically coupled to a first pivot, point 18 defined on said frame 12. As illustrated in FIG. 1, the first ends 16*a,* 16*b* of the primary foot links 14 are pivotally coupled to the pivot point 18 by coupling members which comprise a pair of crank arms 20*a,* 20*b.* However, it is to be understood that these crank arms 20 may be replaced by other elements. For example, a flywheel may be mounted to the first pivot point 18, and the first ends 16 of the primary foot links 14 may be directly connected to the flywheel. In other embodiments, the primary foot links 14 may be connected to the first pivot point 18 by a linkage comprised of multiple pivotally connected elements as illustrated, for example, in U.S. Pat. Nos. 6,217,485; 5,792,026 or as otherwise known in the art. In any instance, the device is configured so that the first ends 16*a;* 16*b* are constrained to travel in an arcuate path. As is defined herein, an arcuate path comprises a closed, curved path of travel, which may or may not encompass the pivot point 18. Illustratively, a closed curved path of travel includes a circular path of travel, an elliptical path of travel, an oval path of travel, as well as a teardrop shaped path of travel and other such irregular shapes.

The apparatus of the present invention further includes a guide assembly, which is operative to engage the second ends of the primary foot links and to direct those second ends in a reciprocal path of travel. As is to be understood within the context of this disclosure, a reciprocal path of travel is a repetitive backward and forward path of travel in which the forward path and the backward path essentially overlap. As such, a reciprocal path of travel is differentiated from a closed curved path of travel.

In the illustrated embodiment, the guide assembly includes a first and a second swing arm 22*a,* 22*b.* The swing arms 22 are pivotally supported on the frame at a second, front pivot point 24, and as illustrated, handgrip portions 26*a,* 26*b* project therefrom; although, such handgrips may be eliminated in some embodiments. The swing arms 22 each engage a second end 28*a,* 28*b* of a respective primary foot link 14 at an engagement point 30*a,* 30*b* defined on said swing arm. As will be apparent from FIG. 1, the swing arms 22 constrain the second ends 30 of the primary foot links 14 to travel in a generally curved, reciprocal path of travel as the first ends thereof travel in an arcuate path of travel.

In accord with the present invention, and as illustrated in FIG. 1, the device of the present invention further includes a first and a second auxiliary foot link 32*a,* 32*b.* Each auxiliary foot link 32 is associated with a respective primary foot link, and each includes a first end 34*a,* 34*b,* which is pivotally, coupled to the guide assembly, in this instance, a respective swing arm 22. It is notable that the first end 34 of the auxiliary link 32 is connected to the guide assembly at a connection point 36 defined on said guide assembly, and that this connection point 36 is spaced from the engagement point 30 at which the primary link 14 is joined.

Each auxiliary link 32 further includes a second end which is slidably supported upon a respective primary foot link 14, and as illustrated herein, such support is by means of a roller 40*a,* 40*b* which is supported by said auxiliary foot link 32, and which engages the top surface of the primary foot link 14. It is to be understood that other support arrangements are contemplated within the scope of this invention. As illustrated, each auxiliary foot link 32 includes a foot engaging pad 42*a,* 42*b.*

In the operation of the device of the present invention, the first ends 16 of the primary foot links 14 travel in an arcuate path about the first, rear pivot axis 18, while the second ends 30 thereof travel in a reciprocal path. The swing arms 22 further cause the auxiliary foot links 32 to travel in a reciprocal path of travel relative to the primary foot links. This reciprocal path of travel of the auxiliary link extends along at least a portion of the length of the corresponding primary link, between the first and second ends thereof. This mechanical arrangement provides a path of foot travel, as defined by the foot pads 42, which path of travel is longer in stride than would be a comparable path of travel achieved if the auxiliary foot links were eliminated and the foot pads placed directly onto the primary foot links. Accordingly, the overall length of the exercise device may be decreased, while retaining the length of foot travel.

As illustrated, the engagement points 30 and connection points 36 may be made adjustable so that the length of the path of foot travel may be selected to suit various users. For example, moving the engagement point and connection point closer together will shorten the path of foot travel, while increasing the distance therebetween will lengthen the path of foot travel. Also, it is to be understood that the point of connection of the first ends of the primary foot links to their respective coupling members may likewise be adjustable so as to further control the path of foot travel. It is also to be understood that while this description refers to first and second ends of the various links, the term "end" is understood to be a functional end of the respective member; that is to say, the point at which it is connected to a further member; since, in some instances, as for example when the links are made adjustable, connection may not be at the terminus of the member, in which instance, a portion may project therebeyond.

As illustrated in FIG. 1, a flywheel 50 is in mechanical communication with the crank arms 20 and primary links 14. This flywheel 50, while not essential to the operation of the device, serves to provide a smoother foot action by increasing the kinetic mass of the device. In various instances, the flywheel may be eliminated; or, it may be supplemented or replaced by equivalent devices, such as electromagnetic drags or fluid-based devices such as fans, paddles and the like. In certain instances, adjustable resistances such as mechanical, electrical, magnetic or electromagnetic resistances.

A number of modifications and variations of the present invention may be implemented in accord with the teaching hereof.

Figure 2:
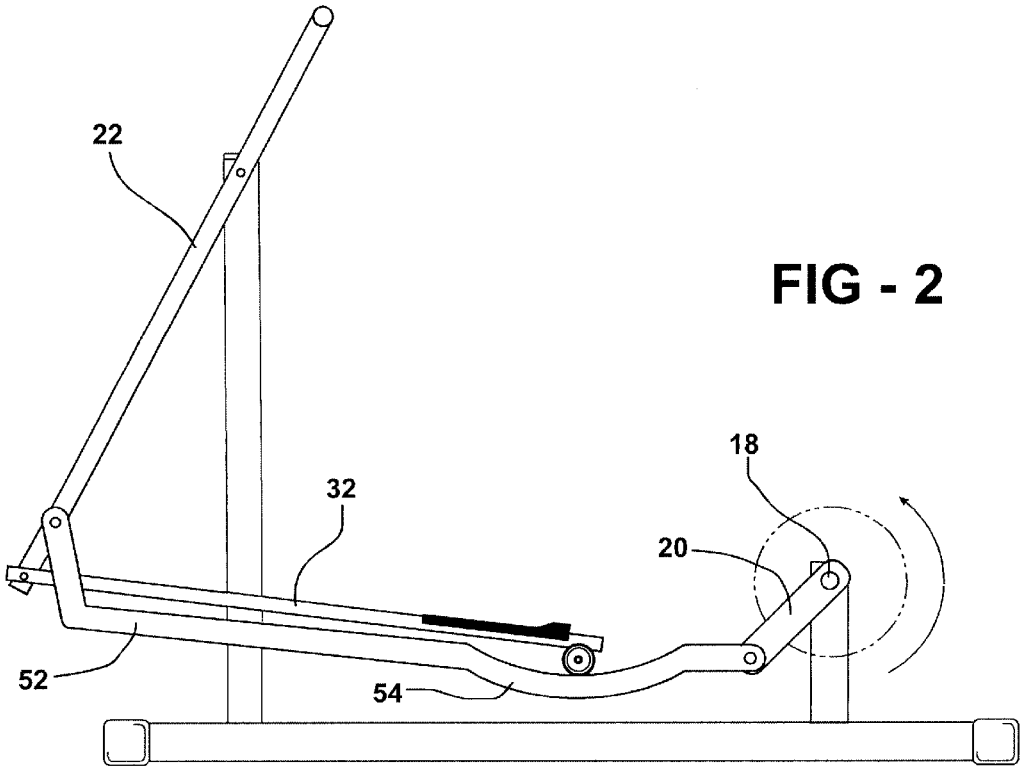
FIG. 2 is a depiction of a portion of another embodiment of exercise device of the present invention.

Referring now to FIG. 2, there is shown a portion of the key mechanical elements of yet another embodiment of the present invention. Shown herein is a portion of a device, which includes a primary link 52, which has a non-planar segment 54, defined thereupon. As illustrated herein, the non-planar segment 54 is a curved segment. However, it is to be understood that the term "non-planar segment" includes any segment, which deviates from a plane defined relative to the remainder of the primary link.

In the FIG. 2 embodiment, the primary foot link is coupled to a pivot axis 18 by a crank arm 20 as generally described hereinabove. Likewise, the second end of the primary link 52 engages a swing arm 22 at an engagement point 30; and the assembly further includes an auxiliary foot link 32 as described above. The second end 38 of this auxiliary foot link 14 travels in a reciprocal path of travel along a portion of the length of the primary link 52, and this path of travel is along at least a portion of the non-planar segment 54. Inclusion of the non-planar segment 54 in the FIG. 2 device will further modify the elliptical path of travel, which is achieved thereby.

Figure 3:
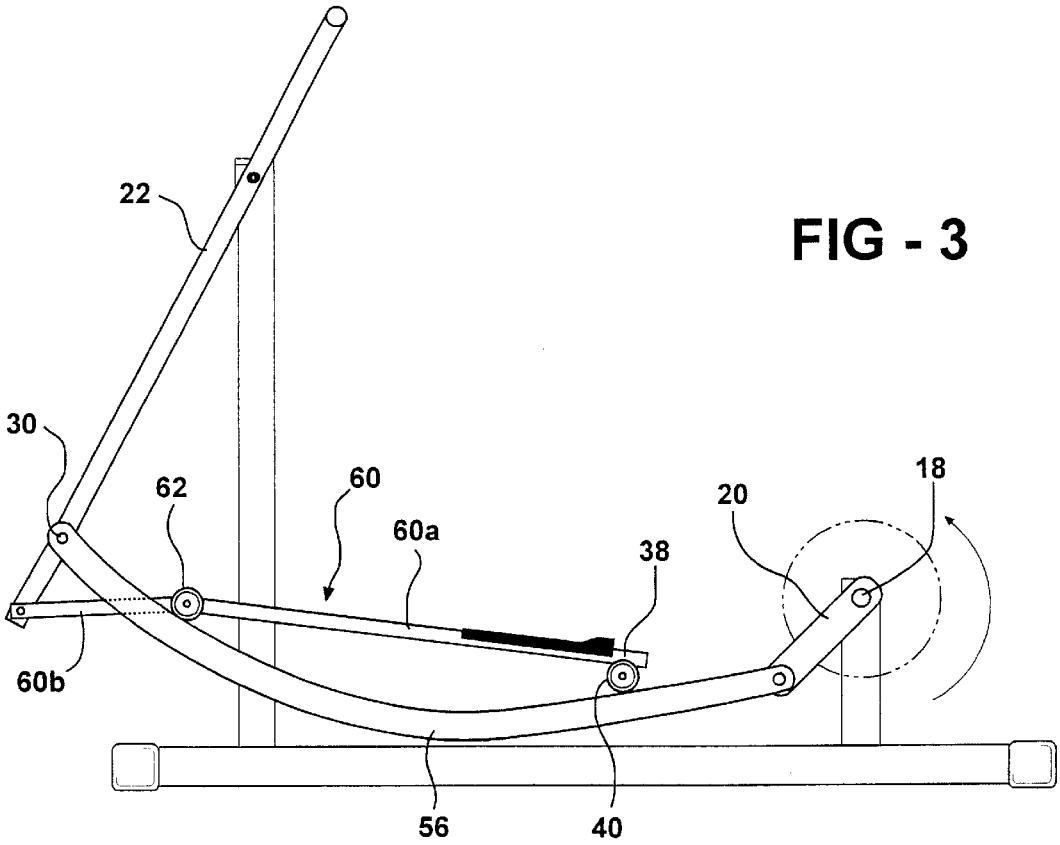
FIG. 3 is a depiction of a portion of yet another embodiment of the present invention.

Referring now to FIG. 3, there is shown a portion of yet another embodiment of the present invention. In this embodiment, a primary foot link 56 is of a generally flattened V shape, and it is coupled to a first pivot axis 18 by a crank arm 20, and to a swing arm 22 as generally described hereinabove. As shown herein, the auxiliary link 60 includes a first segment 60*a* and a second segment 60*b,* which are pivotally connected together. This auxiliary foot link includes a roller 40 at a second end 38 thereof as previously described; and it further includes an intermediate roller 62 where the two segments 60*a,* 60*b* are pivotally connected together.

Figure 4:
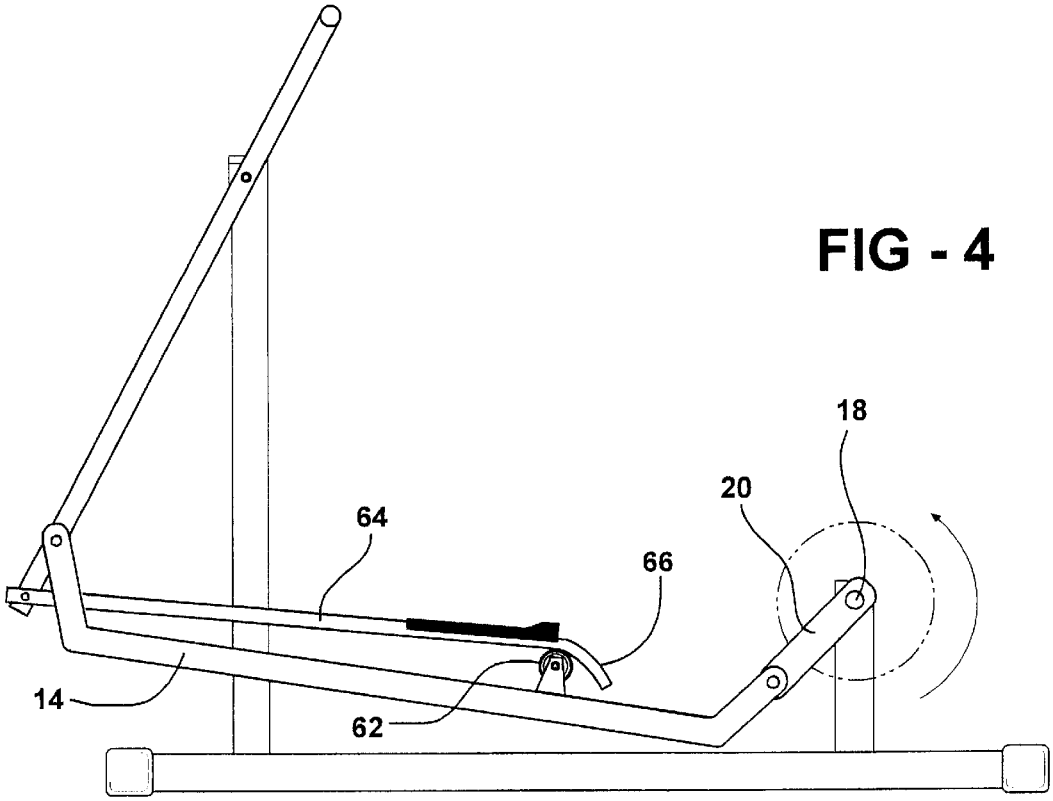
FIG. 4 is a depiction of a portion of another embodiment of exercise device of the present invention.

Referring now to FIG. 4, there is shown a portion of yet another device of the present invention. In this embodiment, the auxiliary foot link slidably engages the primary foot link by means of a roller 62, which is mounted on the primary foot link 14. It is also a notable feature of the FIG. 4 embodiment that the auxiliary foot link 64 includes a curved, non-planar portion 66 defined thereupon. This curved portion 66 serves to further modify the foot action of the device; however, it is to be understood that in yet other embodiments, the auxiliary link 64 may be straight, otherwise curved, or otherwise shaped.

Figure 5:
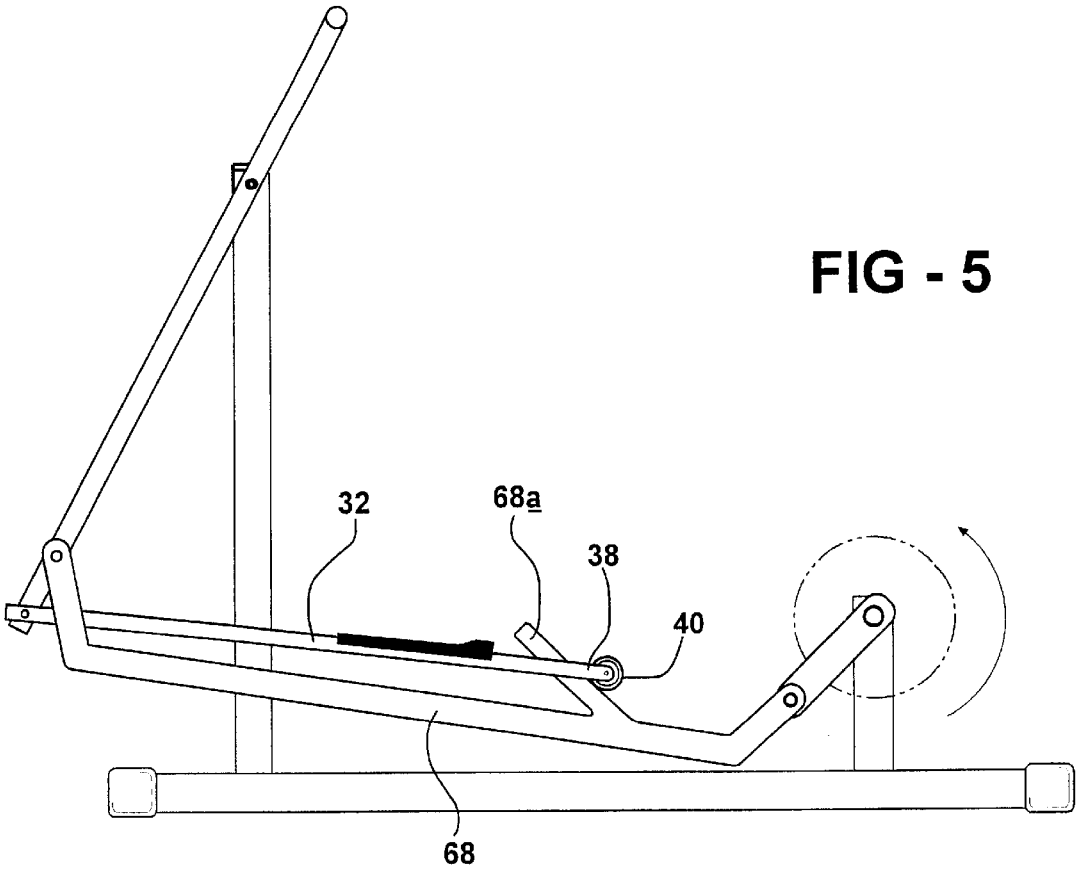
FIG. 5 is a depiction of a portion of another embodiment of the present invention.

FIG. 5 depicts yet another variation of the present invention. As illustrated therein, an elliptical exercise device includes a primary link 68 having a non-planar, ramp portion 68*a* defined thereupon. In this embodiment, the second end 38 of an auxiliary link 32 engages this ramp portion 68*a* by means of a roller 40. In operation, the roller 40 moves along the ramp portion, as well as along a remainder of the planar portion of the primary link 68. As in the foregoing embodiments, the remaining connections and linkages are unchanged.

Figure 6:
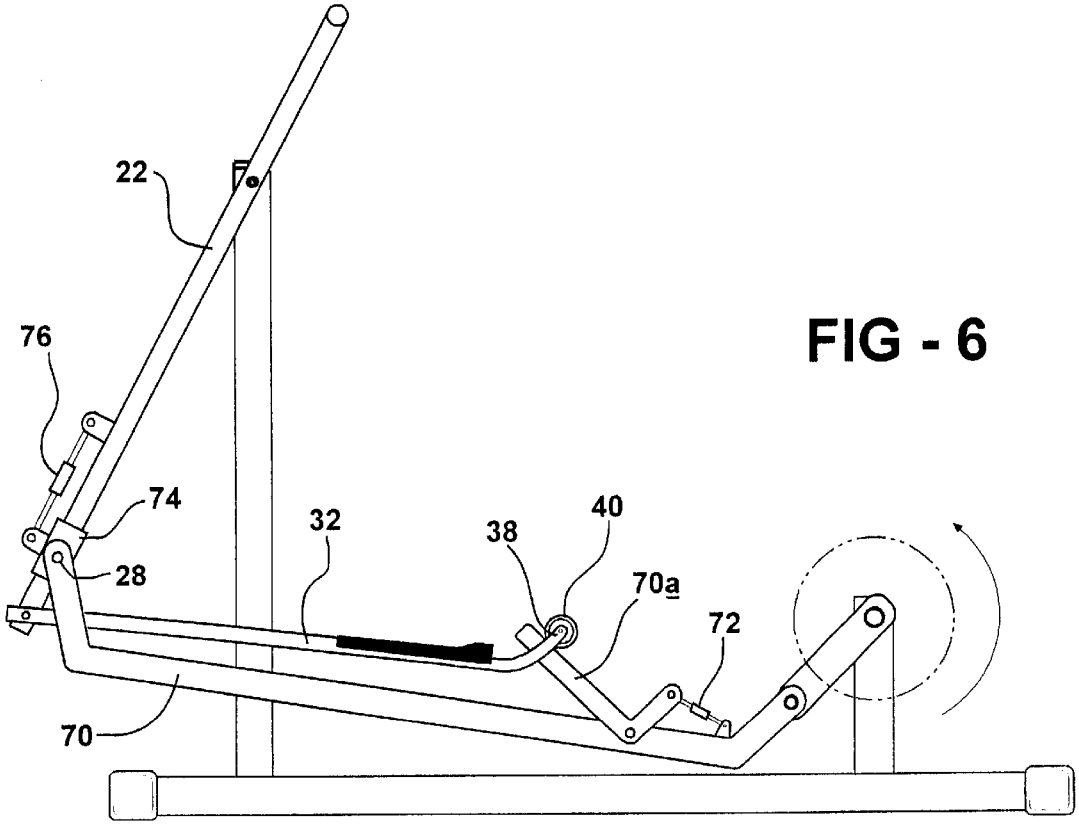
FIG. 6 is a depiction of another embodiment of the present invention illustrating adjustable linkages for varying foot path and stride.

As referred to above, the various connection and engagement points in the present invention may be made adjustable, as well as may be other features of the invention. As illustrated in FIG. 6, a primary foot link 70 includes a pivotably adjustable ramp portion 70*a,* which engages a roller 40 retained on the second end 38 of an auxiliary foot link 32. As shown herein, this ramp portion 70*a* may be raised and lowered relative to the remainder of the primary foot link 70 by means of an adjuster 72. This adjuster may comprise a manual adjuster such as a turnbuckle, or it may comprise a powered adjuster such as a solenoid, motor driven screw, linear actuator, hydraulic actuator or the like.

As further illustrated in FIG. 6, the second end 28 of the primary foot link 70 is pivotally engaged to a collar 74, which is slidably displaceable along the length of a swing arm 22. As further illustrated, the slidable collar 74 is retained in place on said swing arm 22 by an adjustable connector 76. This connector is analogous to the connector 72 described above and is operable to adjust the location of the slidable connector 74 and hence the location of the engagement point. In this manner, the length of the stride achieved by the depicted linkage may be adjustably controlled. In those instances where a powered adjuster 76 is employed, stride length may be adjusted while the device is in operation. It is to be understood that the various adjustability features shown in this invention may be used independently or in conjunction. Likewise, similar adjustment mechanisms may be incorporated with regard to the auxiliary foot link 32, as well as with other connection points herein.

Although not illustrated, the frame may also be made to be adjustable. For example, the frame may be configured so that the front and/or rear portions thereof may be raised and lowered relative to the floor in this manner, the angular relationship of the foot links may be varied relative to the floor, so as to simulate uphill and downhill motion.

While the guide assembly has been described in the foregoing embodiments as including a swing arm, it is to be understood that yet other mechanical arrangements may be implemented in accord with the present invention provided that such mechanical arrangements operate to support the primary and auxiliary foot links at spaced apart engagement and connection points as described above, and to provide for the reciprocal action of the links. Many such mechanical arrangements will be readily apparent to one of skill in the art.

Figure 7:
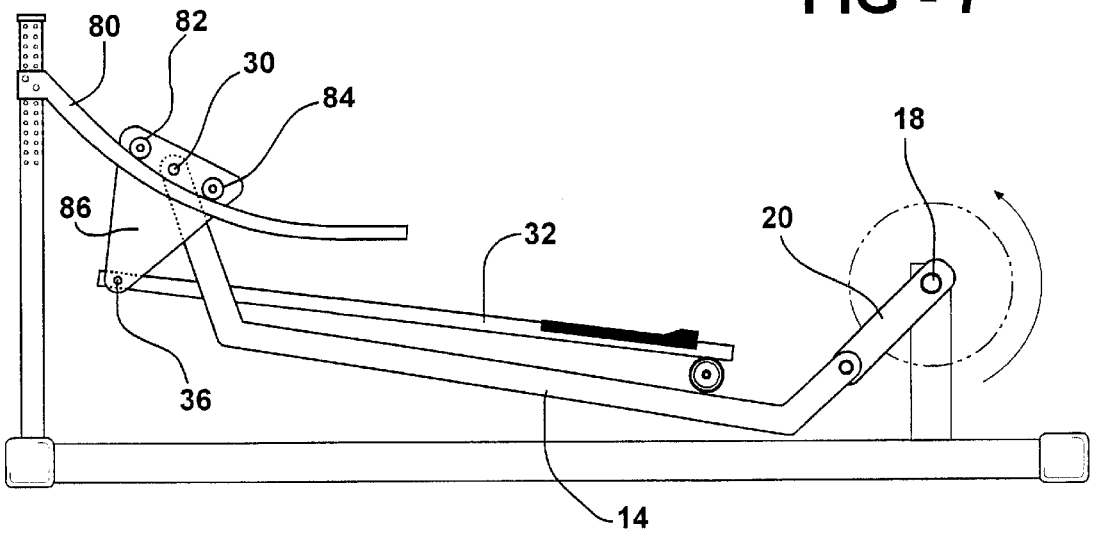
FIG. 7 is a depiction of another embodiment of the present invention wherein the guide member includes a track.

Referring now to FIG. 7, there is shown an alternative configuration of guide assembly. In this embodiment, the guide assembly includes a curved track 80, which is most advantageously supported by the frame member 12. The guide assembly further includes a pair of rollers 82, 84 that engage the track. Affixed to the rollers 82, 84 are a support member 86. The support member 86 supports and retains the primary foot link 14 and second foot link 32 at an engagement point 30 and connection point 36 which are spaced apart. As illustrated, the frame 12 may, adjustably support the track 80, so that its height and angular relationship may be adjusted relative to the floor. The remaining elements are as described hereinabove. It is to be understood that the various other features and variations of the present invention may also be incorporated into this specific embodiment. Yet other variations of the guide assembly will be apparent to one of skill in the art in view of this teaching.

Figure 8:
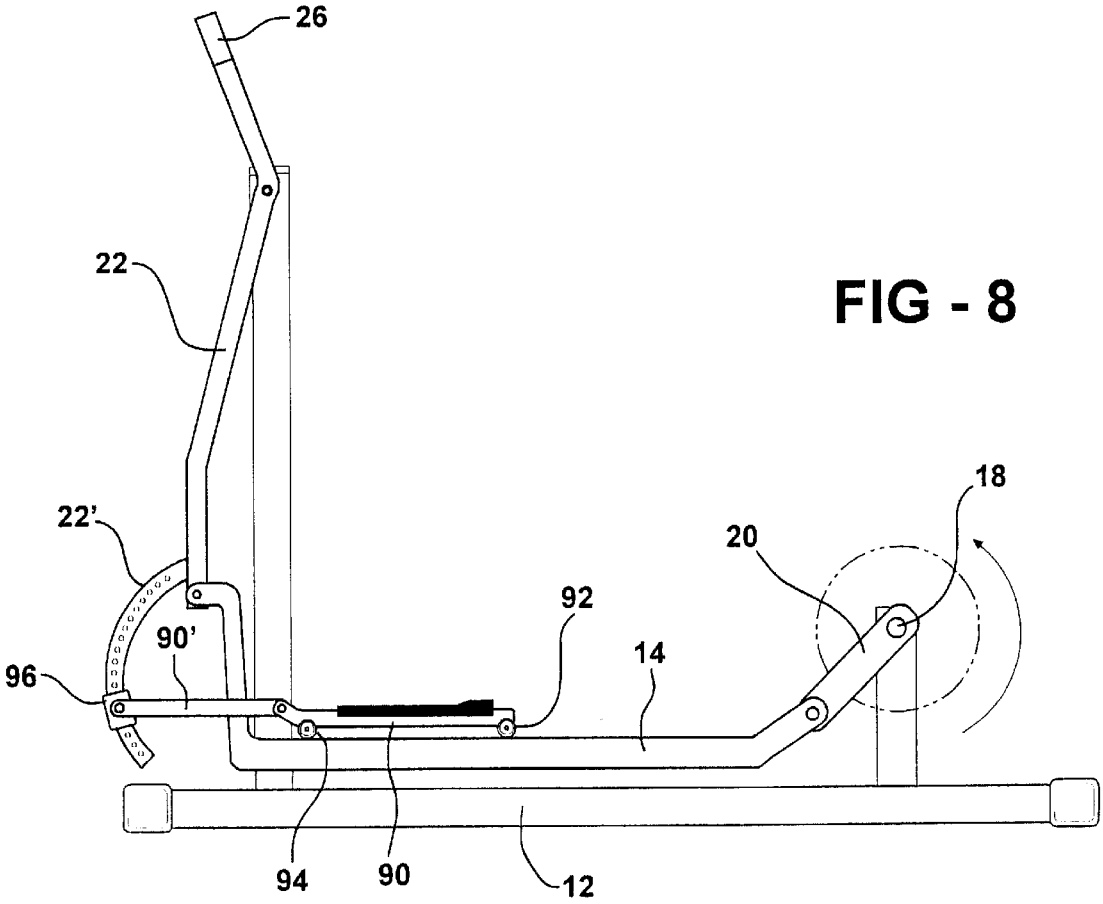
FIG. 8 is a depiction of yet another embodiment of the present invention, which provides for adjustability of stride length.

Referring now to FIG. 8, there is shown yet another embodiment of the present invention which provides for stride length adjustment. As illustrated, the exercise device includes a frame 12 and primary link 14. As in various of the previous embodiments, the first end of the primary link 14 is coupled to a first pivot axis 18 by a coupling member, which in this instance is a crank arm 20, which provides for arcuate motion of the first end. The second end of the primary link 14 is coupled to a guide, which comprises a swing arm 22. The swing arm is pivotally supported on the frame, and includes a handle extension 26 as in the previous embodiments. This swing arm 22 provides for reciprocal motion of the second end of the primary link 14.

In the FIG. 8 embodiment, the guide assembly further includes a curved extension portion 22' projecting from the remainder of the swing arm 22. This connection portion 22' is generally curved, and serves to engage the first end of an auxiliary link 90. As illustrated herein, the auxiliary foot link 90 is a hinged member, which includes a connection portion 90' pivotally, connected to the remainder of the body of the auxiliary foot link 90. As further illustrated, the auxiliary foot link 90 includes a first and a second roller 92, 94. In this embodiment, the connection portion 90' of the auxiliary foot link 90 is connected to the connection portion 22' of the swing arm by a connector collar 96. As illustrated, the connection point between the auxiliary link 90, and the connection portion 42' of the swing arm 22, may be adjusted, and this adjustment will vary the stride length provided by the device. As illustrated, the connection portion 22' over the swing arm 22 is a curved segment. It is to be understood that this connection portion may be otherwise configured; however, it has been found that when this member is curved, as is shown in FIG. 8, the relative geometry of the linkages is preserved through the entire operating cycle of the device so that the shape of the path of foot travel is relatively constant for various stride lengths. Connection of the second end of the auxiliary foot link 90 to the connection portion 22' of the swing arm 22 may be accomplished by various adjustable connected devices such as friction collars, pin and hole connectors, and the like. The connection may be manually adjustable, or may be made to be automatically adjustable by the inclusion of powered actuators as discussed hereinabove. It is also to be noted that for simplicity of illustration, the FIG. 8 embodiment only depicts one set of linkages, and the actual embodiment includes two such sets of linkages, as will be clear by reference to FIG. 1.

Figure 9:
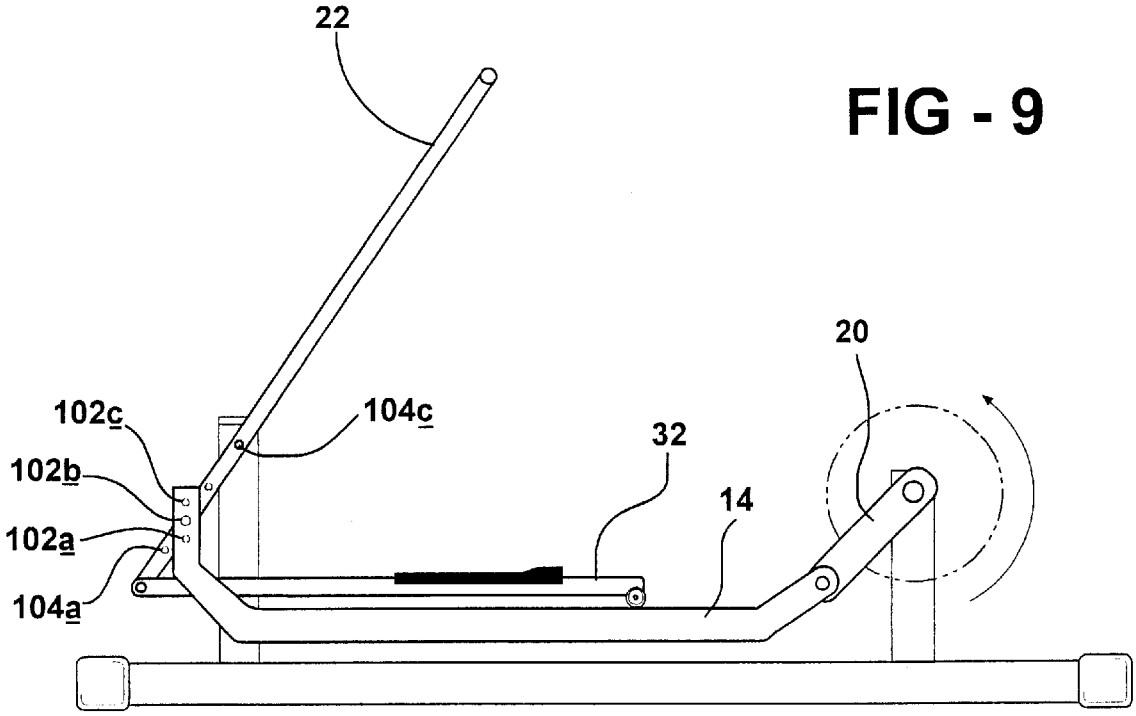
FIG. 9 is a depiction of a portion of another embodiment of exercise device of the present invention which provides for adjustability of stride length.

Referring now to FIG. 9, there is shown yet another embodiment of exercise device of the present invention, which is configured so as to allow for adjustability of stride length. For simplicity of illustration, the FIG. 9 drawing only shows a primary link 14, auxiliary link 32, crank arm 20 and swing arm 22, all as generally described hereinabove. It is to be understood that the device will also include a frame and a second set of the depicted elements.

As in the previous embodiments, a primary foot link 14 engages a crank arm 20, or other such coupling member, which directs the first end of the primary foot link in an arcuate path of travel. The second end of the primary foot link 14 engages a guide assembly, which in this depicted embodiment is a swing arm 22. As previously described, the auxiliary foot link 32 engages the swing arm, and has a second end which engages the primary foot link. All of these elements are generally similar in form and function to those illustrated hereinabove, particularly in FIG. 1.

The FIG. 9 embodiment provides for adjustability of stride length, and in this regard it will be noted that the primary foot link includes three holes 102*a*, 102*b*, 102*c* formed therein. These holes 102 function as coupling points for joining the primary foot link 14 to the swing arm 22. In this regard, the swing arm 22 has a number of holes defined therein, and in the illustration, holes 104*a*, 104*c* are visible, and an intermediate hole 104*b* is hidden from view and is in alignment with hole 102*b* of the primary link 14. These holes 104 function to define engagement points on the swing arm 22. Connection between the primary foot link 14 and the swing arm 22 may be accomplished by means of a pin or similar member which passes through corresponding holes of each member. It is also to be understood that other means for establishing this connection may also be implemented in accord with the present invention, as is known in the art.

As illustrated in FIG. 9, hole 102*b* of the primary link 14 is coupled to a corresponding hole (not shown) in the swing arm 22. This configuration provides a medium stride length. A longer stride length may be achieved by coupling hole 102*c* of the primary link to hole 104*c* of the swing arm 22. Conversely, a shorter stride length may be achieved by coupling hole 102*a* to hole 104*a*. In all instances, the geometric relationship of the auxiliary link 32, the swing arm 22, and the primary link 14 will be preserved. Therefore, the FIG. 9 embodiment may employ a relatively simple, straight, auxiliary link 32, while still preserving the elliptical geometry across the range of adjustments.

While the FIG. 9 embodiment shows three adjustment holes on each of the primary link 14 and swing arm 22, it is to be understood that a larger or a smaller number of holes may be likewise employed. Also, while the embodiment of FIG. 9 is preferably utilized to allow for adjustability of stride length without any variation in relative foot path geometry, the FIG. 9 embodiment may be used so as to vary foot path geometry, if noncorresponding points on the swing arm and primary link are coupled together. It is also to be understood that this particular feature of adjustability may be employed with various of the other embodiments of the invention shown herein.

The foregoing drawings, discussion and description are illustrative of specific embodiments of the present invention, but are not meant to be limitations upon the practice thereof. It is the following claims, including all equivalents, which define the scope of the invention.

What is claimed is:

1. An exercise device comprising:

a frame member configured to be supported on a floor, said frame member having a first pivot axis defined thereupon;

a first and a second primary foot link, each primary foot link having a first end and a second end;

a first and a second coupling member, each coupling member being disposed so as to couple the first end of a respective one of said primary foot links to said first pivot axis so that said respective first ends of said primary foot links each travel in an arcuate path;

a guide assembly operative to engage the second end of each of said first and second primary foot links at an engagement point defined upon said guide assembly, and to direct said second ends of said primary foot links in a reciprocating path of travel as said first ends thereof travel in said arcuate path; and a first and a second auxiliary foot link, each auxiliary foot link being configured to receive a user's foot, and each having a first end which is coupled to said guide assembly at a connection point defined upon said guide assembly, which connection point is spaced from said engagement point, each auxiliary link being slidably supported by a respective one of said primary foot links at a location which is between the first end and the second end of said primary foot link, so that a second end of each auxiliary foot link will travel in a reciprocal path along a portion of the length of its respective primary foot link between the first and second ends thereof, when said first end of said respective primary foot link travels in said arcuate path and said second end of said respective primary foot link travels in said reciprocal path.

2. The exercise device of claim 1, wherein said guide assembly includes a first and a second swing arm, each swing arm being pivotally supported on said frame at a second pivot axis defined thereupon, each swing arm being pivotally connected to a respective one of said first and second auxiliary foot links at a respective engagement point thereupon.

3. The exercise device of claim 1, wherein each of said auxiliary links is slidably supported by its respective primary foot link by a roller.

4. The exercise device of claim 3, wherein said roller is fixed upon said respective auxiliary link.

5. The exercise device of claim 1, wherein each of said coupling member pivotally couples the first end of its respective primary foot link to said first pivot axis.

6. The exercise device of claim 1, wherein said arcuate path encompasses said first pivot axis.

7. The exercise device of claim 1, further including a flywheel supported on said frame and in mechanical communication with the first end of each of said primary foot links.

8. The exercise device of claim 2, wherein each swing arm has a handgrip associated therewith.

9. An exercise device comprising:

a frame member configured to be supported on a floor, said frame member having a first and a second pivot axis defined thereupon;

a first and a second primary foot link, each primary foot link having a first end and a second end;

a first and a second crank arm, each crank arm being disposed so as to couple the first end of a respective one of said primary foot links to said first pivot axis so that said respective first ends of said primary foot links each travel in an arcuate path;

a guide assembly including a first and a second swing arm, each swing arm being pivotally connected to said frame at said second pivot axis, and each swing arm being operative to engage the second end of a respective primary foot link at an engagement point defined on said swing arm, and to direct said second ends of said primary foot links in a reciprocating path of travel as at first ends thereof travel in said arcuate path; and a first and a second auxiliary foot link, each auxiliary foot link being configured to receive a user's foot, and each having a first end which is coupled to a respective swing arm at a connection point defined upon said swing arm, which connection point is spaced from said engagement point, each auxiliary link being slidably supported by a respective one of said primary foot links at a location which is between the first end and the second end of said primary foot link, so that a second end of each auxiliary foot link will travel in a reciprocal path along portion of the length of its respective primary foot link, between the first and second ends thereof, when said first end of said respective primary foot link travels in said arcuate path and said second end of said respective primary foot link travels in said reciprocal path.

10. An exercise device comprising:

a frame member configured to be supported on a floor, said frame member having a first pivot axis defined thereupon;

a first and a second primary foot link, each primary foot link having a first end and a second end;

a first and a second coupling member, each coupling member being disposed so as to couple the first end of a respective one of said primary foot links to said first pivot axis so that said respective first ends of said primary foot links each travel in an arcuate path;

a guide assembly operative to engage the second end of each of said first and second primary foot links at an engagement point defined upon said guide assembly, and to direct said second ends of said primary foot links in a reciprocating path of travel as said first ends thereof travel in said arcuate path; and a first and a second auxiliary foot link, each auxiliary foot link being configured to receive a user's foot, and each having a first end which is coupled to said guide assembly at a connection point defined upon said guide assembly, which connection point is spaced from said engagement point, each auxiliary link having a second end having a roller affixed thereto, wherein each auxiliary link is slidably supported by said roller upon a respective one of said primary foot links so that the second end of each auxiliary foot link will travel in a reciprocal path along a portion of the length of its respective primary foot link between the first and second ends thereof, when said first end of said respective primary foot link travels in said arcuate path and said second end of said respective primary foot link travels in said reciprocal path.

11. The exercise device of claim 1, wherein said guide assembly includes a track and wherein the second ends of the first and second primary foot links are in mechanical communication with the track so as to be supported and directed thereby.

12. The exercise device of claim 11, wherein the guide assembly further includes an auxiliary link support member which is supported by said track and which has said connection point defined thereupon at a location spaced apart from said track.

13. The exercise device of claim 11, wherein said track is supported by said frame.

14. The exercise device of claim 13, wherein said track is supported by said frame so as to be positionally adjustable relative thereto.

15. The excise device of claim 3, wherein said roller is fixed upon said respective primary link.

16. The exercise device of claim 1, wherein said primary links each include a non-planar segment defined thereupon; and wherein the second ends of each of said auxiliary links travel in a reciprocal path along at least a portion of the non-planar segment of their respective primary links.

17. The exercise device of claim 16, wherein said non-planar portion is moveable relative to the remainder of said primary link.

18. The exercise device of claim 1, wherein said first and second auxiliary links each include at least two segments hingedly joined together.

19. The exercise device of claim 18, wherein said first and second auxiliary links each include two rollers.

20. The exercise device of claim 1, wherein the location of at least one of said engagement points and said connection point on said guide assembly may be varied.

21. The exercise device of claim 1, wherein each of said auxiliary foot links includes a non-planar segment, and wherein at least a portion of said non-planar segment slidably engages a respective primary foot link.

* * * * *